US006958728B2

(12) United States Patent
Liu

(10) Patent No.: US 6,958,728 B2
(45) Date of Patent: Oct. 25, 2005

(54) FLAT ANTENNA

(76) Inventor: Cheng-Fang Liu, No. 243, Yong-an Road, Meinong Township, Kaohsiung County (TW) 843

( * ) Notice: Subject to any disclaimer, the term of this patent is extended or adjusted under 35 U.S.C. 154(b) by 1 day.

(21) Appl. No.: 10/752,681

(22) Filed: Jan. 8, 2004

(65) Prior Publication Data

US 2005/0110684 A1 May 26, 2005

(30) Foreign Application Priority Data

Nov. 24, 2003 (TW) ..... 92132876 A

(51) Int. Cl.[7] ..... H01Q 1/38; H01Q 1/24

(52) U.S. Cl. ..... 343/700 MS; 343/702; 343/895

(58) Field of Search ..... 343/700 MS, 702, 343/872, 873, 895

(56) References Cited

U.S. PATENT DOCUMENTS 5,541,610 A * 7/1996 Imanishi et al. ..... 343/702
5,798,737 A * 8/1998 Kanaba et al. ..... 343/895
5,818,398 A * 10/1998 Tsuru et al. ..... 343/895
5,870,065 A * 2/1999 Kanba et al. ..... 343/895
5,870,066 A * 2/1999 Asakura et al. ..... 343/895
5,933,116 A * 8/1999 Suesada et al. ..... 343/702
6,028,568 A * 2/2000 Asakura et al. ..... 343/895
6,064,351 A * 5/2000 Mandai et al. ..... 343/873

* cited by examiner

*Primary Examiner*—Tan Ho
(74) *Attorney, Agent, or Firm*—Fei-Fei Chao; Bingham McCutchen LLP

(57) ABSTRACT

A flat antenna has multiple overlapped dielectric substrates on which printed circuits are formed and interconnected to constitute first and second radiation units to supply a dual-operation frequency band. The first radiation unit is created by multiple circuits with different shapes that are interconnected to form a three-dimensional configuration. The second radiation unit is created by an L-shaped circuit and electrically connects to the first radiation unit at a common feeding node. By properly adjusting the circuit length of the first radiation unit or the second radiation, it is easy to acquire a desired resonance frequency value and frequency ratio.

17 Claims, 10 Drawing Sheets

FLAT ANTENNA

BACKGROUND OF THE INVENTION

1. Field of the Invention

The present invention relates to a flat antenna, and more particularly to a flat antenna having a meandering configuration constructed by such a way that conductive traces are printed on multiple layers of dielectric substrates and electrically connected by plated through hole (PTH) process. The flat antenna is suitable for use in any wireless equipment such as a wireless mobile phone, a wireless modem or for use in a local area network (LAN).

2. Description of Related Art

The rapid developments in the wireless communication field have led to a variety of new communication apparatuses and technologies in recent years. Basically, these communication products are required to be multi-functioning in a miniature size. Such requirements are also applied to wireless antennae used with the new communication products. The requirements are able to be achieved by the antenna structure consisting of a substrate (70) on which meandering radiator (71) is formed, shown in FIG. 1. With such a configuration, the length and the area of the antenna can be effectively increased within a limited substrate.

Besides the aforementioned mini size requirement, a wireless antenna needs to have multiple channels and be able to support wide operation frequency bandwidth. For example, some established operation frequency standards include EGSM (880–960 MHz), DCS(1710–1880 MHz), PCS(1850–1990 MHz) and WCDMA/CDMA2000 (1920–2170 MHz). These standards are mainly separated into two groups based on an operation frequency band, i.e. a first operation frequency band (880–960 MHz) with 80 MHz bandwidth and a second operation frequency band (1710–2170 MHz) with 460 MHz bandwidth.

However, the actual frequency bandwidth in the second frequency band (1710–2170 MHz) used by a conventional antenna is only 280 MHz (1710–1990 MHz). Obviously, a conventional antenna does not effectively utilize such a wide operation frequency bandwidth.

Further, the antennae of the wireless communication products can be distinguished into an external type and an internal type based on the installation position. The most commonly used external type antenna has a circular appearance if the antenna is created as a spiral configuration. To vary the appearance of the antenna, the flat structure is suitable for forming a rectangular, square or an elliptical antenna.

Moreover, the chip type antenna also can be implemented by the flat structure, which could be electrically mounted on a desired circuit board through the surface mounting technology (SMT) thus reducing the cost of the packaging and connecting processes so that the flat structure is quite suitable for use as an internal type antenna.

SUMMARY OF THE INVENTION

An objective of the present invention is to provide a flat antenna with dual operation frequency bands, where the bandwidth of the second frequency band is effectively used.

To accomplished the objective, the flat antenna comprises:

multiple dielectric substrates;

a first radiation unit created on the multiple dielectric substrates, wherein the first radiation unit is constituted of different-patterned conductive circuits that are electrically connected to form a three-dimensional meandering configuration; and a second radiation unit formed by conductive circuits and created on one of the multiple dielectric substrates;

after the multiple dielectric substrates are overlapped, the first radiation unit and the second radiation unit are interconnected to each other, whereby a common feeding node is formed where the first radiation unit connects to the second radiation unit.

With such a configuration, by properly changing the circuit lengths of the first radiation unit and the second radiation unit, the desired resonance frequency values for the two units and the their ratio can be easily acquired, and the second frequency band can reach to a 460 MHz bandwidth.

The patterns of the conductive circuits of the first radiation unit include a straight line pattern, a U-shaped pattern and an inverted U-shaped pattern.

The conductive circuits of the first radiation unit on the overlapped substrates are electrically interconnected by a PTH process.

A feeding port is formed on the dielectric substrate on which the first radiation unit is created, where in the feeding port is connected to a common feeding node at which the first radiation unit connects to the second radiation unit.

A signal transmission circuit is connected between the feed port and the common feeding node.

An external feeding port is formed on the bottom substrate and electrically interconnects to said feeding port.

The foregoing signal transmission circuit is a crooked pattern circuit.

Another objective of the present invention is to provide a dual operation band flat antenna that can serve as an external type antenna or an internal type antenna. To form an external type antenna, the preferable material of the dielectric substrates could be glass fiber so as to create a desired appearance such as a rectangular, a square or an elliptical antenna. Moreover, since the flat antenna itself is able to function as a supporting member and a signal feeding port, the cost for fabricating the supporting member and the signal feeding port is thus low.

To form an internal type antenna, the preferable material for the dielectric substrates could be glass fiber or ceramic thus creating an internal type antenna suitable for surface mounting technology.

Other objects, advantages and novel features of the invention will become more apparent from the following detailed description when taken in conjunction with the accompanying drawings.

DETAILED DESCRIPTION OF THE PREFERRED EMBODIMENT

Figure 2:
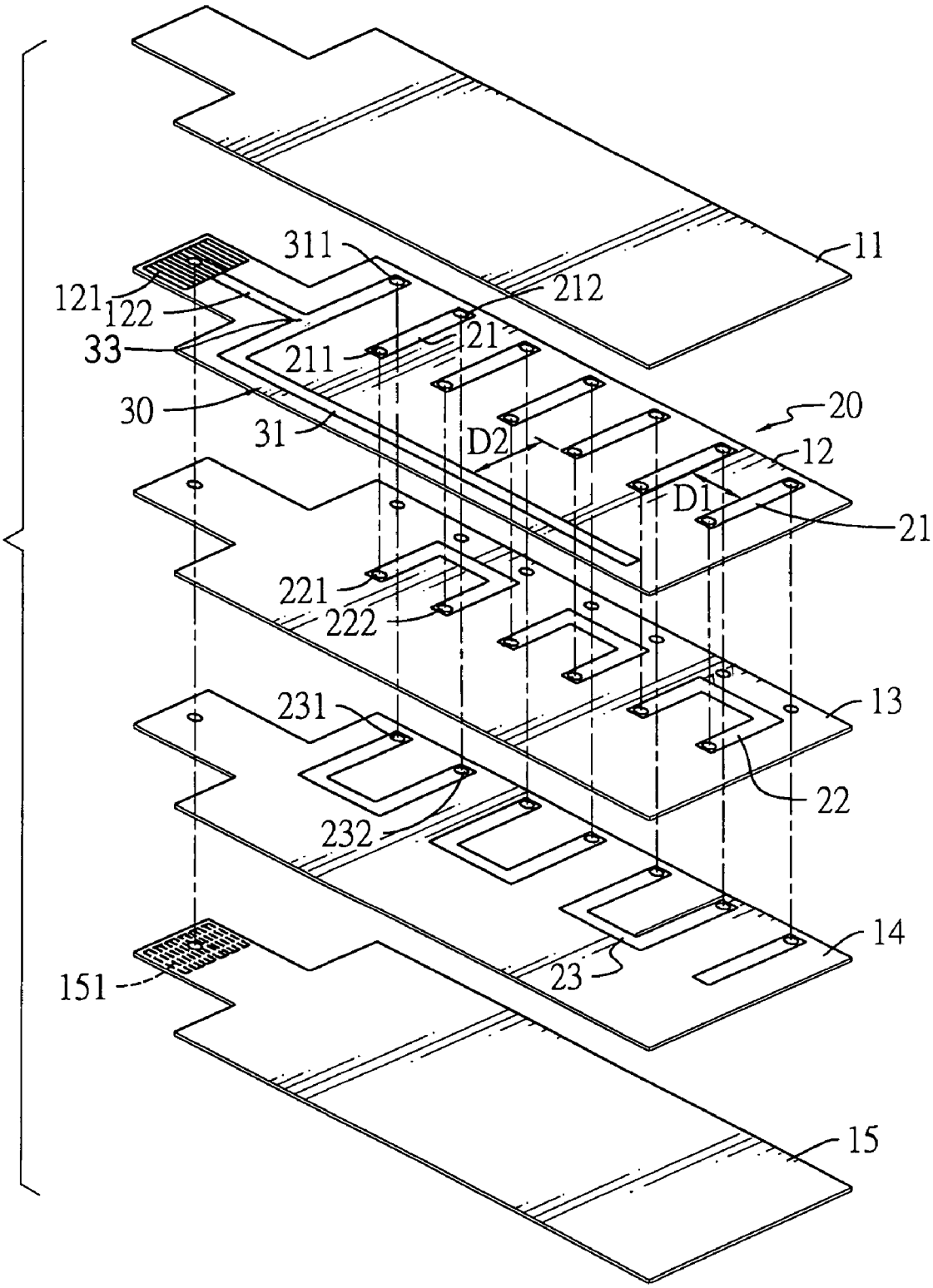
FIG. 2 is an exploded perspective view of a flat antenna according to a first embodiment of the present invention.

With reference to FIG. 2, a first embodiment of a flat antenna of the present invention has a construction that is composed of plural substrates (11, 12, 13, 14 and 15) constituted of ceramic, glass fiber or other dielectric materials. A first radiation unit (20) for operating in a first frequency band and a second radiation unit (30) for operating in a second frequency band are formed on these substrates (11–15). The top substrate (11) and the bottom substrate (15) each function as a dielectric layer, wherein an external feeding port (151) extends from one edge of the bottom substrate (15).

The first radiation unit (20) is composed of multiple conductive circuits (21–23) formed on the different layers of the substrates (12–14). The circuits (21–23) have different shapes including the straight line circuit, the U-shaped and the inverted U-shaped circuit. In the first embodiment, one of two distal ends (221,222) of each inverted U-shaped circuit (22) on the substrate is for connection to a first distal end (211) of one respective straight line circuit (21). A second distal end (212) of one straight line circuit (21) is for connection to a distal end (231 or 232) of one U-shaped circuit (23). When all the substrates (11–15) are overlapped, an interconnection means is applied on these substrates (11–15) to electrically connect the distal ends of the foregoing circuits (21–23). The interconnection means is implemented, for example by forming holes through the substrates (11–15) and electroplating these holes, as well known by the "PTH" process.

Therefore, the distal end (232) of the first U-shaped circuit (23) positioned at the left-most side on the substrate (14) is electrically connected to the distal end (212) of the first straight line circuit (21) positioned at the left-most side on the substrate (12). The other distal end (211) of that first straight line circuit (21) is connected to the distal end (221) of the first inverted U-shaped circuit (22) that is positioned at the left-most side of the third substrate (13). The other distal end (222) of the first inverted U-shaped circuit (22) is connected to a distal end (211) of a second straight line circuit (21) adjacent to the first straight line circuit (21). Similarly, the other distal end (212) of that second straight line circuit (21) is connected to the distal end (231) of a second U-shaped circuit (23). By repeating the foregoing connection, the first radiation unit (20) forms a three-dimensional meandering structure.

The second radiation unit (30) is formed by an L-shaped circuit (31) with a short trace and a long trace, where the L-shaped circuit (31) keeps a predetermined distance D2 away from the first radiation unit (20) whereby the frequency couple effect between the two radiation unit (30) can be reduced. The L-shaped circuit (31) is obtained by printing a conductive trace on the substrate (12). A distal end (311) of the short trace of the L-shaped circuit (31) is electrically connected to the distal end (231) of the first U-shaped circuit (23) formed on the fourth substrate (14). A common feeding node (33) is thus formed where the first and second radiation units (20,30) are connected.

Figure 3:
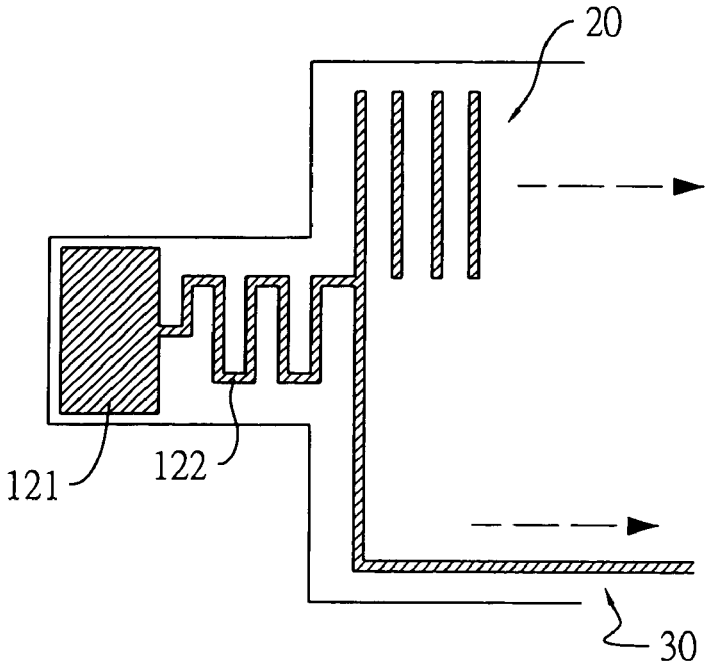
FIG. 3 is a plan view showing an alternative form of a signal transmission circuit connected between a feeding port and a second radiation unit of the present invention.
Figure 4:
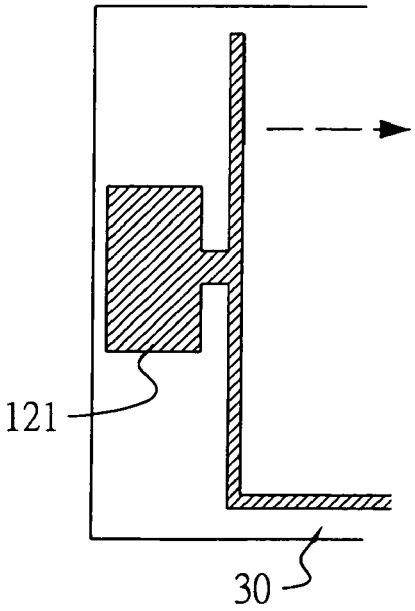
FIG. 4 is a plan view showing an alternative embodiment of a feeding port of the present invention.

Further, a feeding port (121) extending from one edge of the substrate (12) is also electrically connected to the external feeding port (151) of the bottom substrate (15) through the interconnection means. As shown in FIG. 2, the feeding port (121) is connected to the L-shaped circuit (31) by a printed signal transmission circuit (122) formed by printing. Another alternative shape of the signal transmission circuit (122) is shown in FIG. 3. The purpose of the crooked pattern design is for adjusting the resonance frequency of the first operation band and the second operation band. Moreover, as shown in FIG. 4, the feeding port (121) can be directly connected to the second radiation unit (30) without the signal transmission circuit (122), wherein such a configuration allows the flat antenna to be mounted on any desired circuit board (not shown) by surface mount technology (SMT).

With reference to FIG. 3, based on the foregoing structure, the current flows of the first radiation unit (20) and the second radiation unit (30) are substantially parallel to each other.

It is to be noted that by properly changing the circuit lengths of the first radiation unit (20) and the second radiation unit (30), the desired resonance frequency value for each radiation unit (20)(30) and the ratio of the two resonance frequency values can be easily acquired.

Moreover, in the first embodiment, the three types of conductive circuits (21–23) of the first frequency band are sequentially formed on the second layer substrate to the fourth layer substrate (12–14). However, the arrangement sequence on these substrates (12–14) of the conductive circuits (21–23) is not limited.

Figure 1:
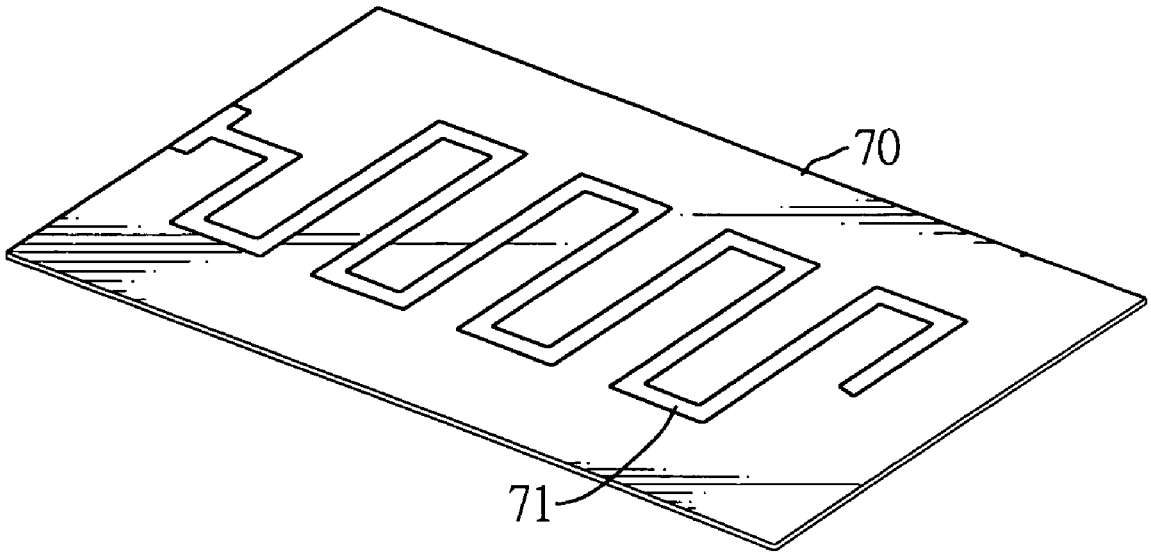
FIG .1 PRIOR ART
FIG. 1 is a perspective view of a conventional flat antenna.
Figure 5:
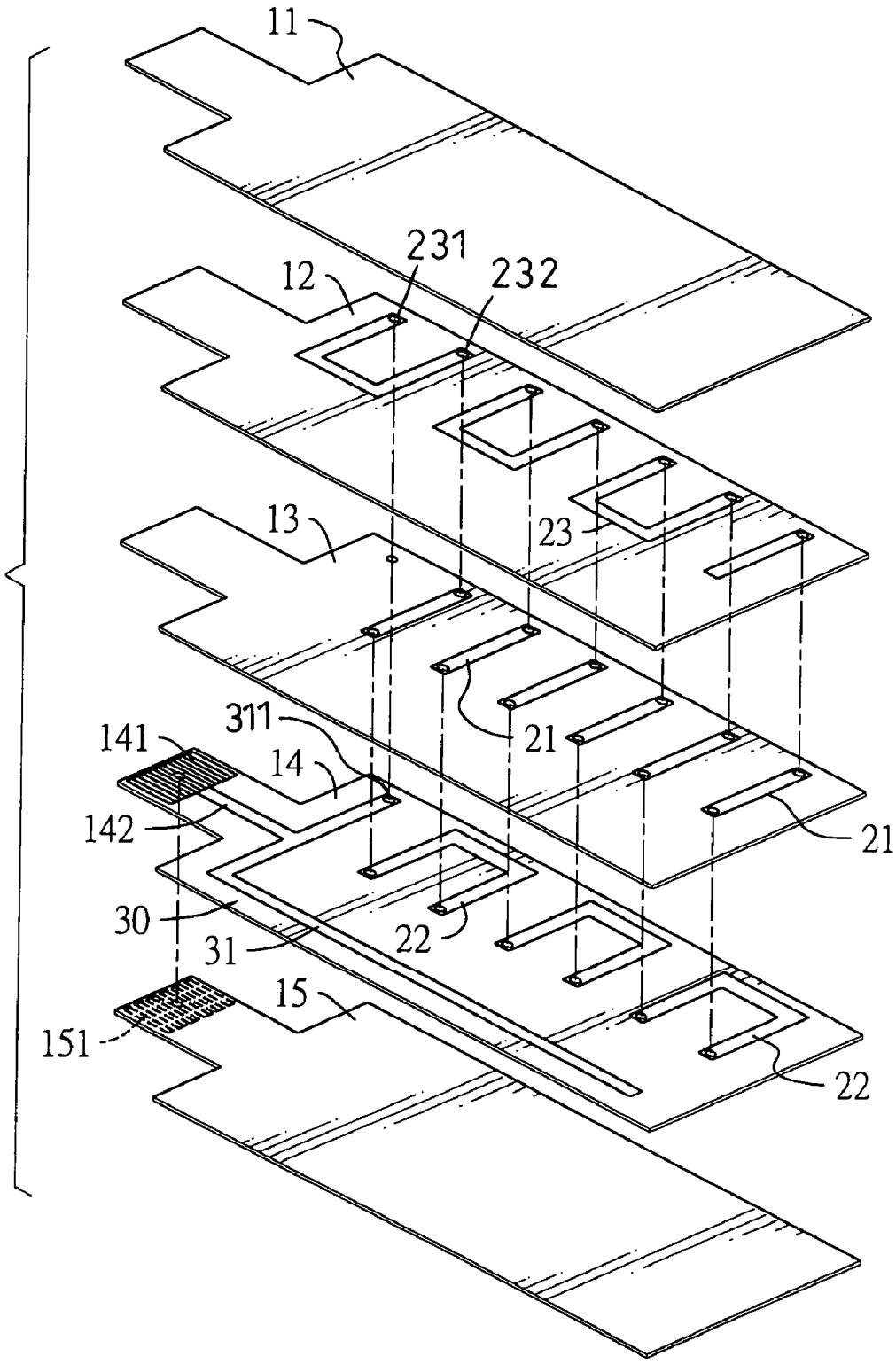
FIG. 5 an exploded perspective view of a flat antenna according to a second embodiment of the present invention.

With reference to FIG. 5, the second embodiment of the flat antenna is substantially the same as the first embodiment of FIG. 1. The difference is that the straight line circuits (21) are formed on the third substrate (13). The U-shaped circuits (23) and the inverted U-shaped circuits (22) are respectively formed on the second substrate (12) and the fourth substrate (14). Similarly, these circuits (21–23) can be electrically interconnected by the PTH process as mentioned above to form a three-dimensional meandering structure.

The second radiation unit (30) in the second embodiment is also the L-shaped pattern and formed on the same layer where the inverted U-shaped circuits (22) are formed, i.e. the fourth substrate (14). The distal end (311) of the short trace of the L-shaped circuit (31) is electrically connected to the distal end (231) of the U-shaped circuit (23) printed on the second substrate (12), whereby the two radiation units (20)(30) are electrically connected.

A feeding port (141) extending from one edge of the fourth substrate (14) electrically connects to the external feeding port (151) on the fifth substrate (15). The connection between the feeding port (141) and the two radiation units (20,30) can be implemented by a signal transmission circuit (142), where the pattern of the signal transmission circuit (142) could be a straight line or a crooked line. Also, the feeding port (141) can directly connect to the two radiation units (20,30) as shown in FIG. 4.

Figure 6:
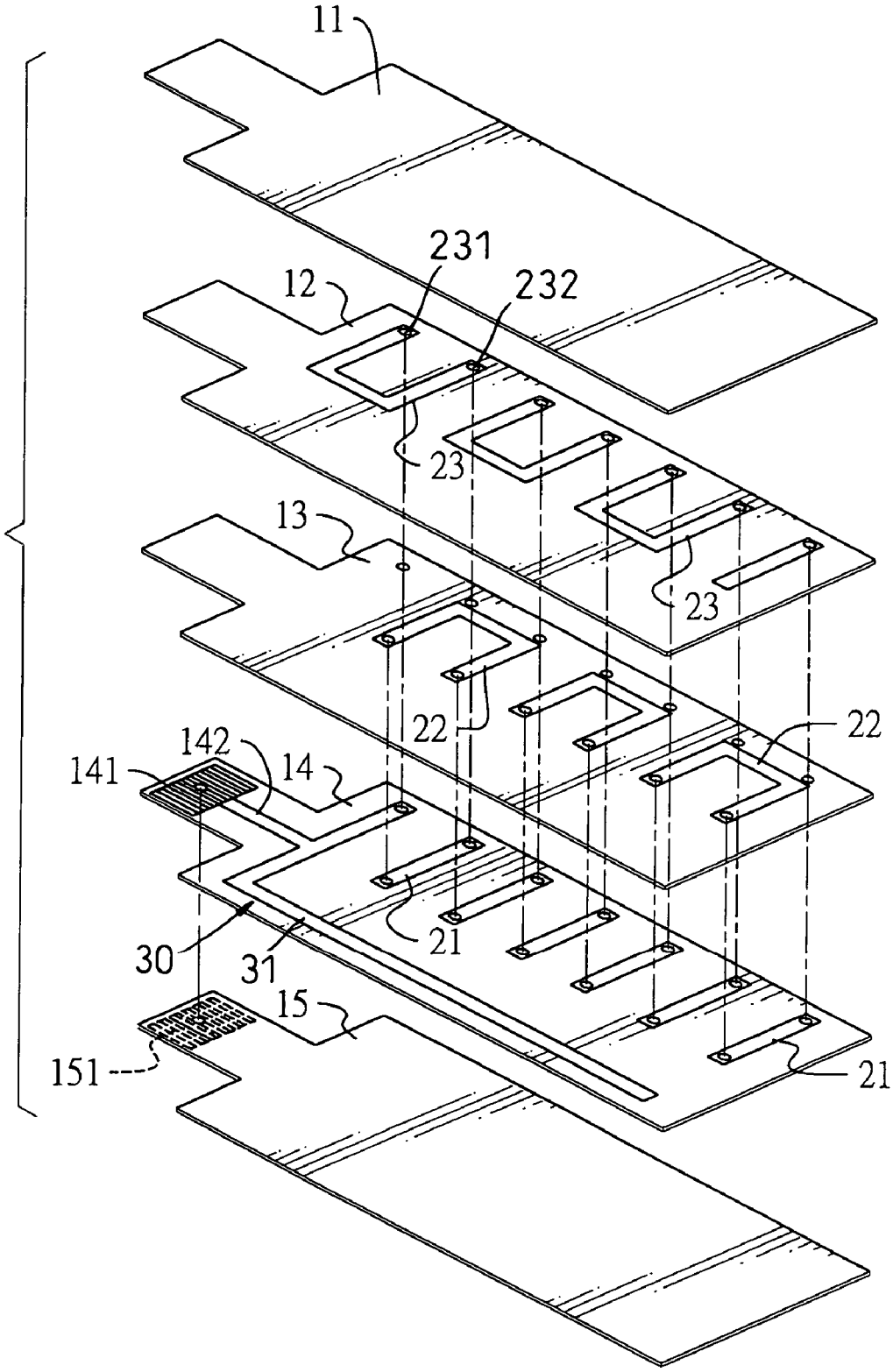
FIG. 6 an exploded perspective view of a flat antenna according to a third embodiment of the present invention.

With reference to FIG. 6, a third embodiment of the flat antenna is also similar to the first and the second embodiments. The changed portion is that the U-shaped circuits (23), the inverted U-shaped circuits (22) and the straight line circuits (21) are sequentially formed on the second, third and fourth substrates (12–14), where these circuits (21–23) are also interconnected to each other to configure the three-dimensional structure by the PTH interconnecting process.

The second radiation unit (30) constituted of an L-shaped trace is printed on the fourth substrate (14) on which the straight line circuits (21) are formed. The distal end (311) of the L-shaped circuit (31) is connected to the distal end (231) of the U-shaped circuit (23) on the second substrate (12).

A feeding port (141) extending from one edge of the fourth substrate (14) electrically connects to the external feeding port (151) on the fifth substrate (15). The connection between the feeding port (141) and the two radiation units (20,30) can be implemented by a signal transmission circuit (142), where the pattern of the signal transmission circuit (142) can be a straight line or a crooked line. Also, the feeding port (141) can directly connect to the two radiation units (20,30) as shown in FIG. 4. Such an embodiment still possesses the same features of the first and the second embodiments.

According to the foregoing description, the first radiation unit (20) is operated in company with the second radiation unit (30) to respectively serve as a first frequency band and a second frequency band. However, the first radiation unit (20) also can be individually operated and serve as a single frequency band.

Figure 7:
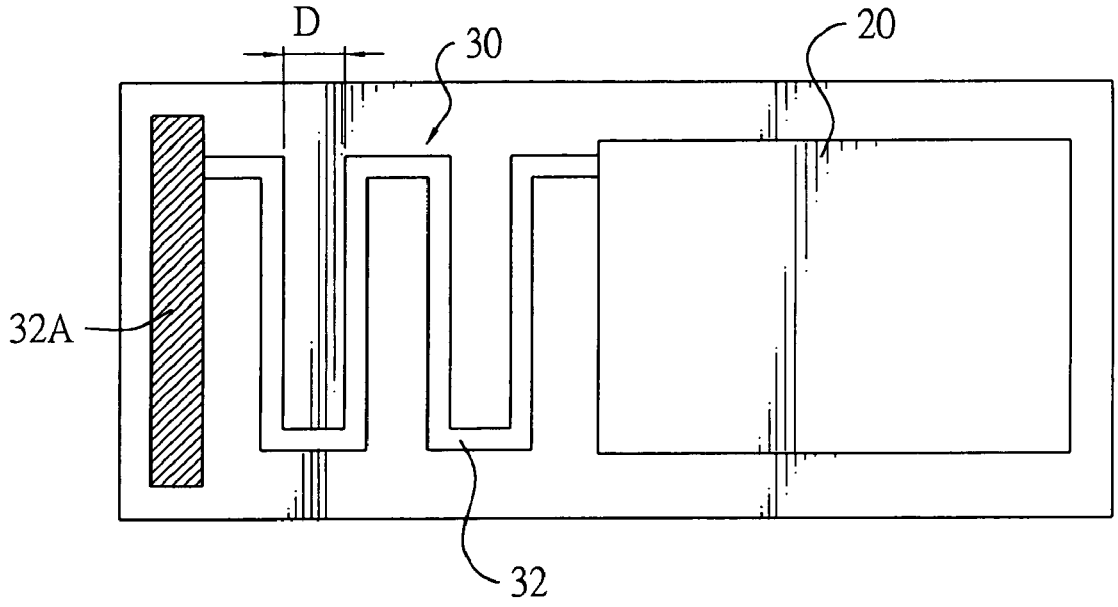
FIG. 7 is a plan view of a flat antenna according to a fourth embodiment of the present invention.

With reference to FIG. 7, the fourth embodiment of the flat antenna is substantially the same as the foregoing embodiments. The first radiation unit (20) is also created by the straight line, U-shaped and inverted U-shaped conductive circuits formed on the different layers of the substrates. The second radiation unit (30) is implemented by the straight trace or continuously flat crooked trace. In the present embodiment, the second radiation unit (30) is formed as the flat crooked trace (32). A feeding port (32A) formed on the substrate is connected to one terminal of the flat crooked trace (32) to guide the radiation signals into the flat antenna. The other terminal of the flat crooked trace (32) connects to the first radiation unit (20). The structure of the fourth embodiment also enables the flat antenna to attain dual frequency bands. It should be noted that a distance "D" designated on FIG. 7, which is measured between two adjacent parallel segments of the flat crooked trace (32), should be larger than two times of a distance "D1" measured between adjacent straight line circuits (21) shown in FIG. 2. That is to say, D>2×D1. If the second radiation unit (30) is intended to be operated at a higher frequency, the straight line pattern is the preferable shape.

Figure 8:
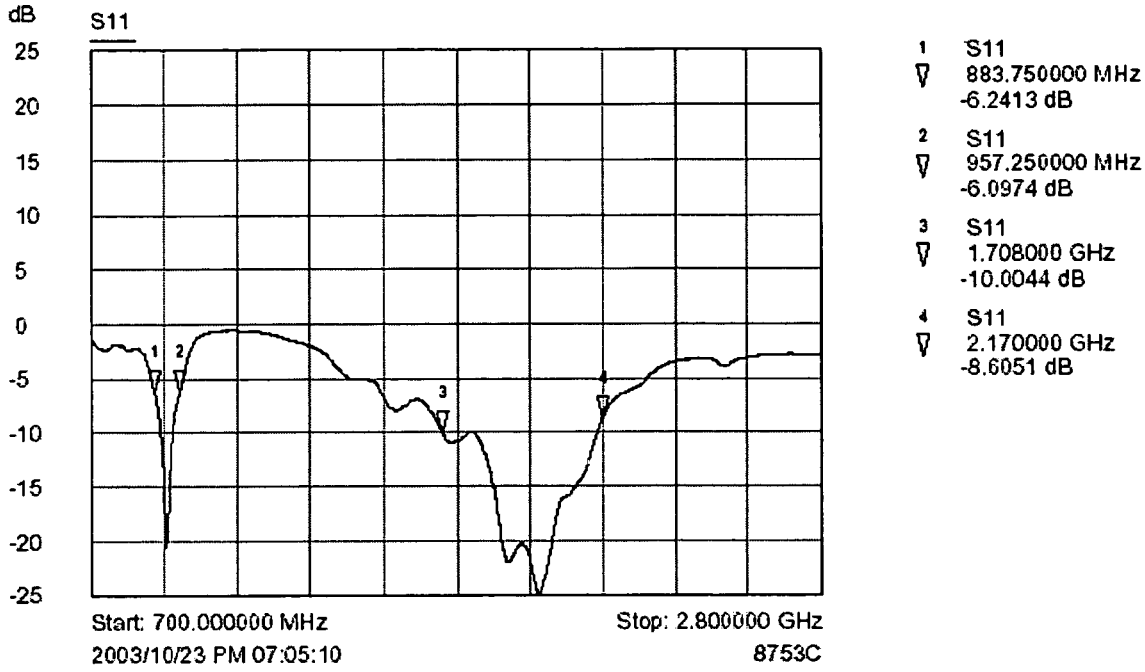
FIG. 8 shows graph of the return loss versus the operation frequency.
Figure 9:
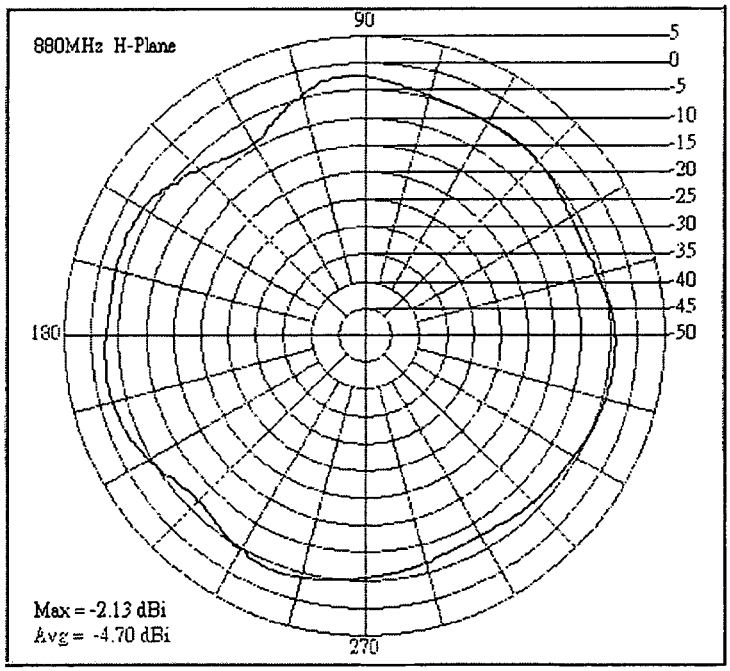
FIG. 9 is a Polar gain plot showing the H-plane radiation pattern while the operation frequency is 880 Mhz.
Figure 10:
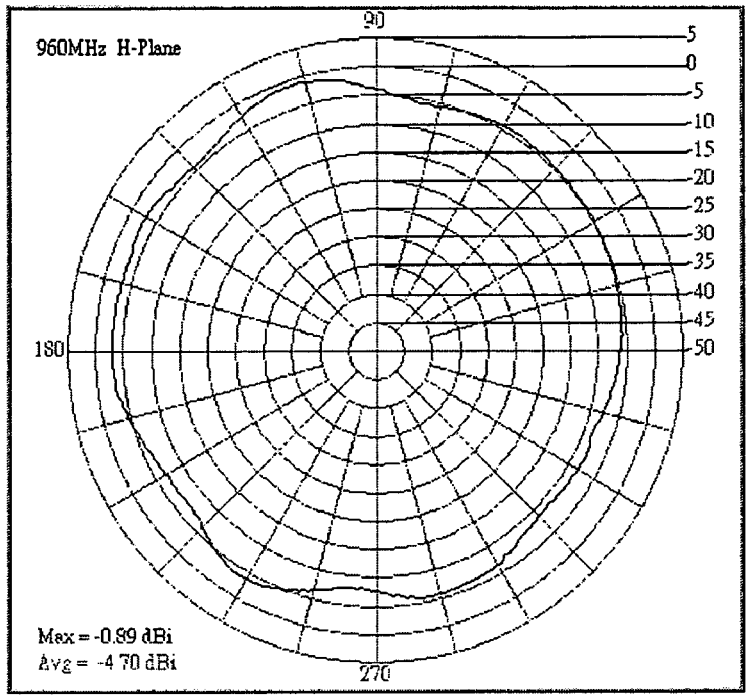
FIG. 10 is a Polar gain plot showing the H-plane radiation pattern while the operation frequency is 960 Mhz.
Figure 11:
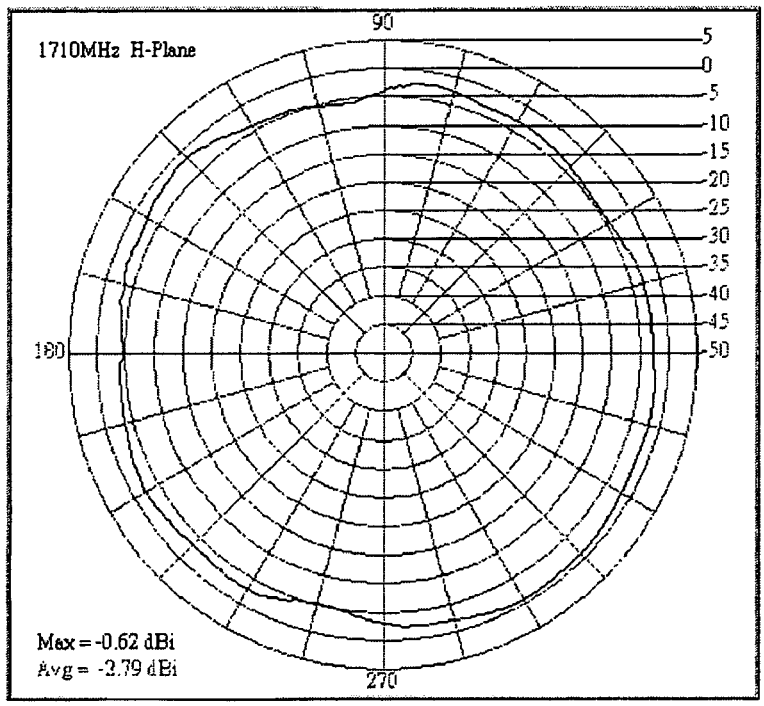
FIG. 11 is a Polar gain plot showing the H-plane radiation pattern while the operation frequency is 1710 Mhz.
Figure 12:
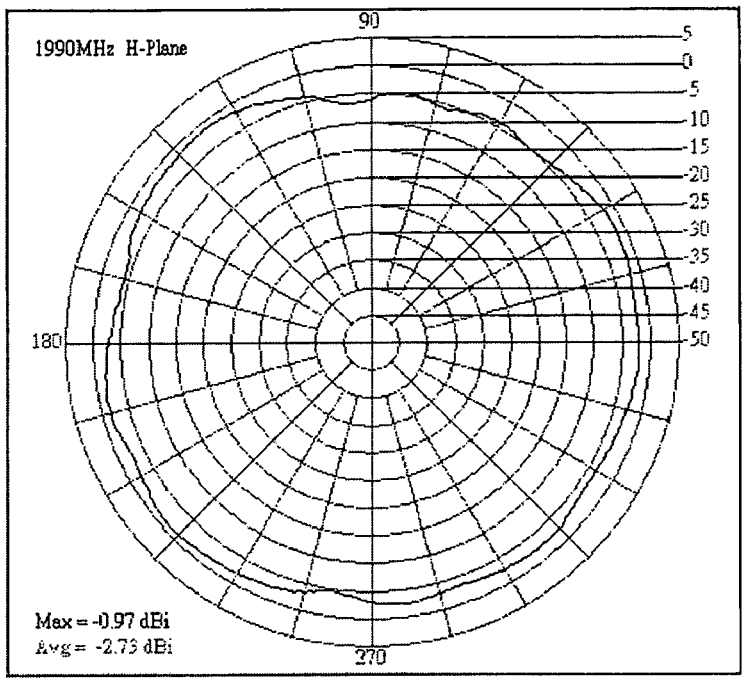
FIG. 12 is a Polar gain plot showing the H-plane radiation pattern while the operation frequency is 1990 Mhz.
Figure 13:
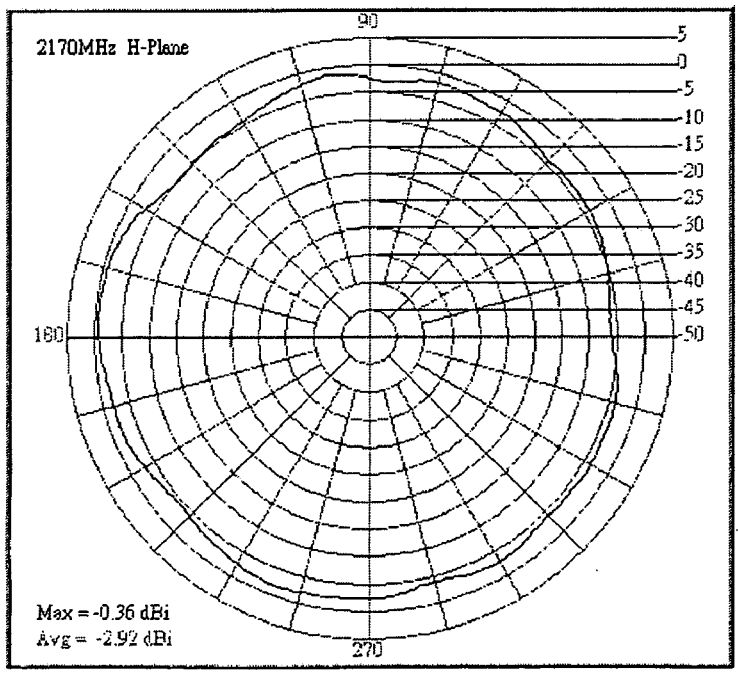
FIG. 13 is a Polar gain plot showing the H-plane radiation pattern while the operation frequency is 2170 Mhz.

With reference to FIG. 8, the experiment result of the second embodiment of the flat antenna is shown. A first measured return loss value is approximate to −6.2 dB while the operation frequency is 880 MFz (as shown at the point designated by numeral "1"). Another measured return loss value is approximate to −6.1 dB while the operation is 960 MHz (as shown at the point designated by numeral "2"). Within the range from 880 MHz to 960 MHz, the first frequency band has an 80 MHz bandwidth. At the frequency 1710 MHz, the approximate measured return loss value is −10 dB (as shown at the point designated by numeral "3"). At the frequency 2170 MHz, the approximate measured return loss value is −8.6 dB. Within the range from 1710 MHz to 2170 MHz, the second frequency band has a 460 MHz bandwidth.

The horizontal-plane (H-plane) gain values measured according to different operation frequencies are shown in FIGS. 9 to 13. From FIGS. 9 to 13, the operation frequency values are 880 MHz, 960 MHz, 1710 MHz, 1990 MHz and 2170 MHz, where the maximum gain values respectively corresponding to the foregoing frequency values are −2.13 dBi, −0.89 dBi, −0.62 dBi, −0.97 dBi and −0.36 dBi.

Figure 14:
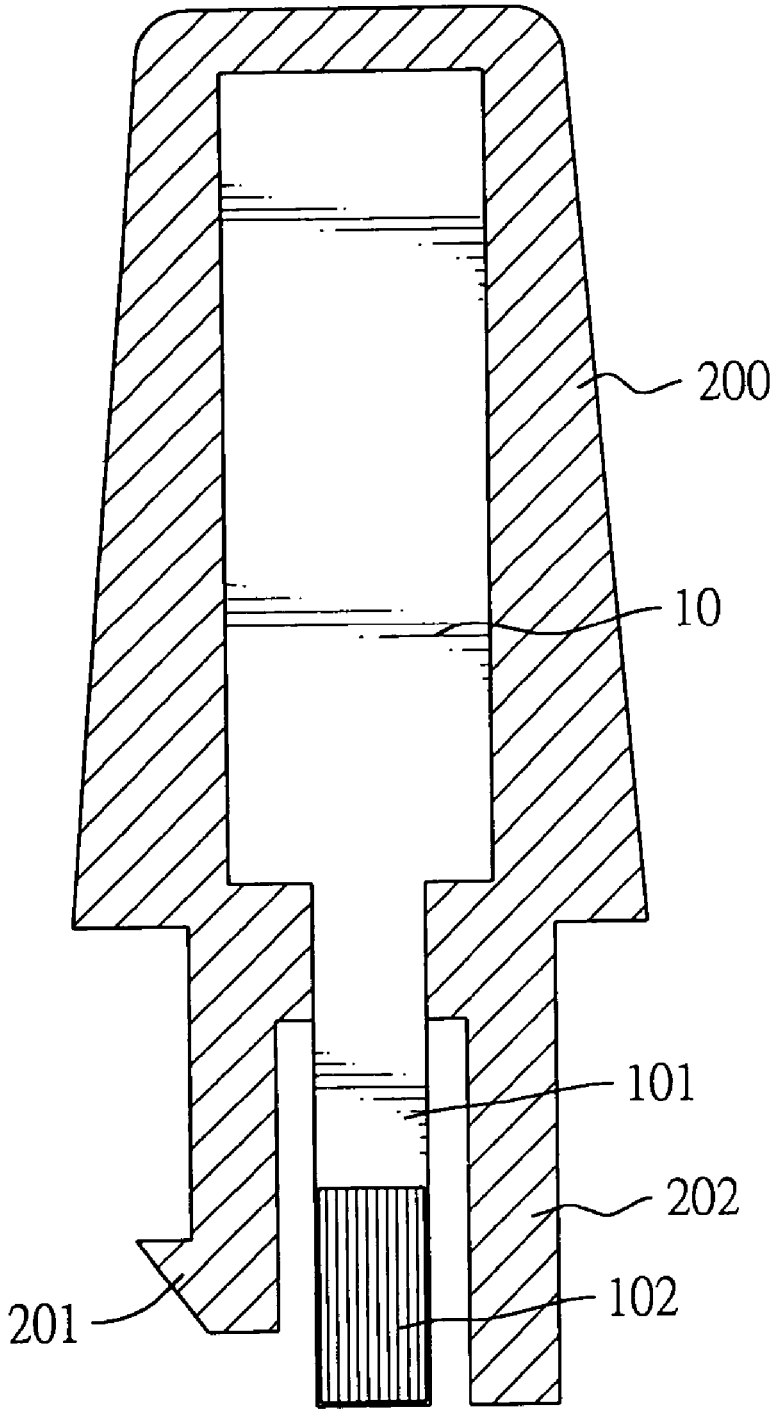
FIG. 14 is a cross section view of a packed flat antenna.

As shown in FIG. 14, the flat antenna (10) in accordance with the present invention is further packed by a hollow body (200) constituted of insulating material. As mentioned above, the material for the substrates could be glass fiber so as to form different appearances, such as a rectangular shape, a square shape or an elliptical shape. An extending portion (101) is exposed from the hollow body (200) and an external feeding port (102) is formed on the extending portion (101) can support the flat antenna (10) when the flat antenna (10) is installed on an electrical device (not shown). A guiding leg (202) and a hook (201) encircling the extending portion (101) are integrally formed at opposite sides of a bottom surface of the hollow body (200). When the flat antenna (10) together with the hollow body (200) is installed in a slot of the electrical device, the guiding leg (202) serves as an orientation element to guide the antenna assembly to be located in the proper position. Meanwhile, the hook (201) can secure the antenna assembly to the electrical device.

Because the material for substrate fabrication can be chosen from ceramic material or glass fiber, the flat antenna is suitable for use in the SMT process.

Since the antenna of the present invention is formed by flat substrates, the size of the fabricated laminar antenna can be effectively reduced. Moreover, the antenna can also be formed as a cylindrical or elliptical structure.

According to the foregoing description, the present invention provides a compact and low manufacturing cost flat antenna with dual frequency band, where the resonance frequency of the flat antenna is adjustable and the operation bandwidth of the second frequency band is effectively increased.

It is to be understood, however, that even though numerous characteristics and advantages of the present invention have been set forth in the foregoing description, together with,details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flat antenna comprising:

multiple dielectric substrates;

a first radiation unit created on the multiple dielectric substrates, wherein the first radiation unit is constituted of differently-patterned conductive circuits that are electrically connected to form a three-dimensional meandering configuration; and a second radiation unit formed by conductive circuits and created on one of the multiple dielectric substrates;

after the multiple dielectric substrates are overlapped, the first radiation unit and the second radiation unit are interconnected to each other, whereby a common feeding node where the first radiation unit connects to the second radiation unit is formed.

2. The flat antenna as claimed in claim 1, wherein the patterns of the conductive circuits of the first radiation unit include a straight line pattern, a U-shaped pattern and an inverted U-shaped pattern.

3. The flat antenna as claimed in claim 2, wherein a feeding port is formed on the dielectric substrate on which the first radiation unit is created.

4. The flat antenna as claimed in claim 3, wherein a signal transmission circuit connects between the feeding port and the common feeding node.

5. The flat antenna as claimed in claim 4, wherein an external feeding port is formed on one of said multiple dielectric substrates and electrically interconnects to said feeding port.

6. The flat antenna as claimed in claim 4, wherein said signal transmission circuit is a crooked pattern circuit.

7. The flat antenna as claimed in claim 6, wherein the second radiation unit is an L-shaped circuit.

8. The flat antenna as claimed in claim 3, wherein the second radiation unit is a crooked pattern circuit and connects to the first radiation unit in series.

9. The flat antenna as claimed in claim 3, wherein the second radiation unit is a straight line pattern circuit and connects to the first radiation unit in series.

10. The flat antenna as claimed in claim 1, wherein the second radiation unit is an L-shaped circuit.

11. The flat antenna as claimed in claim 1, wherein the second radiation unit is a crooked pattern circuit and connects to the first radiation unit in series.

12. The flat antenna as claimed in claim 1, wherein the second radiation unit is a straight line pattern circuit and connects to the first radiation unit in series.

13. A flat antenna comprising:

multiple dielectric substrates; and one radiation unit created on the multiple dielectric substrates, wherein the radiation unit is constituted of different patterns conductive circuits that are electrically connected to form a three-dimensional meandering configuration, wherein the patterns of the conductive circuits of said radiation unit include a straight line pattern, a U-shaped pattern and an inverted U-shaped pattern, wherein a feeding port is formed on one of the multiple dielectric substrates and electrically connects to said radiation unit, wherein a signal transmission circuit connects between the feeding port and said radiation unit.

14. The flat antenna as claimed in claim 13, wherein an external feeding port is formed on one of said multiple dielectric substrates and electrically interconnects to said feeding port.

15. The flat antenna as claimed in claim 14, wherein said signal transmission circuit is a crooked pattern circuit.

16. A flat antenna comprising:

multiple dielectric substrates;

a first radiation unit created on the multiple dielectric substrates, wherein the first radiation unit is constituted of different patterns conductive circuits that are electrically connected to form a three-dimensional meandering configuration; and a second radiation unit formed by conductive circuits and created on one of the multiple dielectric substrates;

when the multiple dielectric substrates are overlapped to form an antenna body, a hollow body made from insulating material is provided to packet the antenna body, wherein an extending portion is exposed from the hollow body and an external feeding port is formed on the extending portion, where a guiding leg and a hook are integrally formed at opposite sides of a bottom surface of the hollow body.

17. The flat antenna as claimed in claim 16, wherein said external feeding port electrically connects to the first and the second radiation units.

* * * * *